US006109834A

United States Patent [19]

Chitwood

[11] Patent Number: 6,109,834

[45] Date of Patent: Aug. 29, 2000

[54] COMPOSITE TUBULAR AND METHODS

[75] Inventor: James E. Chitwood, Houston, Tex.

[73] Assignee: Texaco Inc., White Plains, N.Y.

[21] Appl. No.: 09/143,243

[22] Filed: Aug. 28, 1998

[51] Int. Cl.[7] ..... E02B 17/00

[52] U.S. Cl. ..... 405/223.1; 166/350; 405/195.1; 405/224; 114/230

[58] Field of Search ..... 405/195.1, 223.1, 405/224; 166/359, 350, 367; 280/733, 730.2, 743.1; 114/230

[56] References Cited

U.S. PATENT DOCUMENTS

| | | | |
|---|---|---|---|
| 3,934,528 | 1/1976 | Horton et al. . | |
| 3,970,329 | 7/1976 | Lewis | 280/733 |
| 3,975,037 | 8/1976 | Hontschik et al. | 280/733 |
| 3,983,706 | 10/1976 | Kalinowski . | |
| 4,521,135 | 6/1985 | Silcox | 405/223.1 |
| 4,589,801 | 5/1986 | Salama | 405/223.1 |
| 4,728,224 | 3/1988 | Salama et al. | 405/224 X |
| 4,813,815 | 3/1989 | McGehee | 405/224 X |
| 4,923,337 | 5/1990 | Huard | 405/223.1 X |
| 4,938,630 | 7/1990 | Karsan et al. . | |
| 5,039,255 | 8/1991 | Salama | 405/224 |
| 5,390,953 | 2/1995 | Tanaka et al. | 280/733 |
| 5,480,181 | 1/1996 | Bark et al. | 280/730.2 |
| 5,497,832 | 3/1996 | Stuebinger et al. | 166/369 |
| 5,765,869 | 6/1998 | Huber | 280/807 |
| 5,839,753 | 11/1998 | Yaniv et al. | 280/733 |
| 5,941,564 | 8/1999 | Acker | 280/743.2 |

OTHER PUBLICATIONS

Kalman, Mark and Loper, Cobie, *Development of composite–armored flex risers for deep water*, World Oil, Nov. 1998, pp. 103–106.

Proven new Technologies for offshore/onshore applications; Development of Asgard dynamic riser buyoancy modules—World Oil, Jun. 1988.

Product Brochure—"Halliburton Composite Solutions—Fiberspar Spoolable Products", Mar. 1998.

*Primary Examiner*—Dennis L. Taylor

*Attorney, Agent, or Firm*—Harold J. Delhommer; Howrey & Simon

[57] ABSTRACT

The present invention relates to an apparatus and methods for coupling objects that are displaced from one another. In particular, the present invention relates to an apparatus and methods for providing a connection member, for coupling objects that are displaced from one another, that is able to adapt to changing operating conditions. The connection member is a composite tubular that responds to pressure changes such that when the internal pressure of the composite tubular is changed, the length of the tubular proportionally changes, thereby enabling the composite tubular to do useful work.

53 Claims, 10 Drawing Sheets

COMPOSITE TUBULAR AND METHODS

BACKGROUND OF THE INVENTION

1. Field of the Invention

The present invention relates to an apparatus and methods for coupling objects that are displaced from one another. In particular, the present invention relates to an apparatus and methods for coupling objects that are displaced from one another, that is able to adapt to changing operating conditions.

2. Related Art

Designers of composite tubular structures, such as a hose or a tubular, know that positioning the reinforcing fibers or wires is important to the response of the tubular to internal pressure changes. Axially oriented fibers carry axial loads (but limit bending) and circumferential fibers support radial or hoop loads caused by internal pressure. However, helically wound fibers within the construction react and support both axial and hoop loads. The angle of helical fiber lay or lay angle $\alpha$, relative to the central axis of the tubular, controls the ratio of hoop to axial strength contribution that the respective fiber contributes to the overall strength of the tubular. The conventional tubular designer attempts to limit the global response of the tubular to internal pressure changes by using an assortment of fiber angles and arrangements to prevent an axial length change. Thus, such conventional composite structures are not suitable for use where it is desired to adapt to changing operating conditions, such as in the marine environment.

Typically, when a connector is desired for securing a moving object to a fixed location, the connector is chosen according to its physical properties such as strength and size (i.e. length and diameter). In marine applications, such as tension leg deepwater platform mooring systems and riser assemblies, the vertical connection members that secure the platform to the ocean floor are chosen based on such physical properties. For example, in U.S. Pat. No. 3,934,528, a rope of a particular strength is chosen, the length of which is fixed according to the operating depth of the platform. Once the connection, or mooring, member is installed, there is no way to modify it without complete replacement. This limits the function of the mooring during changing operating conditions such as severe winds and rough seas.

Additionally, there are conventional catenary and taut leg mooring systems which use anchor chains and cables with lengths on the order of six times the water depth. Such systems are expensive to fabricate, install and maintain. Additionally, the transportation of the system to the required location is difficult and costly due to the size and weight of the mooring system materials.

Polyester rope has been used as a lightweight alternative in a taut leg configuration. The taut leg configuration uses seafloor anchors placed such that the taut mooring line has a 45 to 60 degree angle from vertical. This allows shorter lengths of rope to provide the elasticity (stretch) required for mooring. However, the mooring polyester rope is large, typically on the order of twelve inches in diameter. Additionally, in order to install the rope, two support vessels are required. During installation and operation of the taut leg mooring system, constant monitoring of the ropes' tension is required to ensure sound operation and safety. Maintenance of the ropes is difficult. If a rope were to snap, replacement is a costly, time-consuming necessary repair. Maintenance is a constant problem since the ropes are susceptible to external damage and abrasion in the marine environment.

Furthermore, the ropes are unable to deploy the seafloor anchors, thus requiring further installation operations and costs.

Some conventional systems use hydraulic cylinders between the 'legs' of the platform to dampen lateral movement of the platform. For example, in U.S. Pat. No. 3,983,706, tension cables are used to secure the platform to anchors, but a hydraulic tensioning system provides lateral support.

Connection members are also often used in pump assemblies where a pump is displaced below the operational platform. Such an assembly is described in U.S. Pat. No. 10 5,497,832, assigned to the assignee of the present invention, the entirety of which is incorporated herein by reference. A typical assembly is a downhole plunger piston pump assembly where the rigid "sucker rod" acts as a connection member between the surface platform and the pump. In order to produce the desired pumping action, large machines are utilized to manipulate the rod. Additionally, since the holes in which the pumps are disposed are extremely deep, the long rod is subject to large loads over a great distance, resulting in frequent fatigue failure. In the event that the pump fails, the entire rod assembly must be removed and the pump retrieved.

Thus, there is a need in the art for a simple and inexpensive apparatus to serve as a connector between two objects. Particularly, there is a need in the art for a composite tubular which acts as a connection member that is able to adapt to changing operating conditions. There is also a need in the art for the use of such a connection member in marine mooring systems, riser assemblies, and downhole pump assemblies.

SUMMARY OF THE INVENTION

The present invention solves the problems with, and overcomes the disadvantages of conventional systems for connection members in general, and connection members in mooring systems, riser assemblies and pump assemblies.

The present invention relates to an apparatus and methods for coupling objects that are displaced from one another. In particular, the present invention relates to an apparatus and methods for providing a connection member for coupling objects that are displaced from one another, that is able to adapt to changing operating conditions.

In one aspect of the present invention, a composite tubular is provided. The tubular has a sidewall which has a length between a first end and a second end. The side wall is made up of fibers and matrix material. The fibers are oriented such that an increase in the internal pressure of the tubular will cause a corresponding decrease in the length of the sidewall. Likewise, a decrease in the internal pressure will cause a corresponding increase in the length of the sidewall, especially with an external tension force applied. There is a pressure control cap at one end of the tubular, which is coupled to a pressure control device to enable the internal pressure of the composite tubular to be changed, and an end cap at the other end of the tubular, which maintains the internal pressure of the tubular. The fibers which make up the tubular sidewall may be wound axially, circumferentially, or helically depending on the desired response to pressure changes.

In another aspect of the invention, multiple composite tubulars, such as those described above, may be bundled together to form a composite tubular bundle. The bundle may be formed by simply axially aligning the multiple composite tubulars or by braiding the tubulars. Alternatively, the multiple composite tubulars may be coupled to the perimeter of a central core.

The composite tubulars, either singly or in bundles, may be utilized in numerous applications. In yet another aspect of the invention, the composite tubulars may be used in a mooring system, as well as a method of vertical and taut-leg mooring. The internal pressure of a composite tubular which is coupled between a floating, tension leg platform and a mooring base is increased. The fibers in the tubular are oriented such that the increase in pressure causes the length of the sidewall of the tubular to decrease. The decrease in the length of the sidewall draws the tension leg platform to its working draft. The internal pressure in the composite tubular can be adjusted to respond to operating conditions.

In still another aspect of the present invention, the composite tubulars may be used in a riser system, as well as a method of operating such riser systems. There is an internal core tubular which has a sidewall that defines a working cavity. Multiple composite tubulars, as described above, are attached to the perimeter of the internal core tubular. The internal pressure of at least one of the composite tubulars may be increased or decreased to cause a decrease or increase in length of the entire tubular assembly. Alternatively, some of the perimeter tubulars may be designed neutral to internal pressure in order to serve as utility lines or guide tubes.

In another aspect of the invention, the composite tubulars may be used in a pump assembly, as well as in a method of operating a pump assembly. The pressure of the composite tubular is cyclically decreased and increased to cause the length of the sidewall of the tubular to increase and decrease, respectively. The composite tubular is connected at one end to a surface platform and at the other end to a pump. The change in length of the tubular causes the pump to operate as will be described herein below.

Accordingly, the present invention provides an apparatus for coupling two objects that are displaced from one another by providing a composite tubular comprised of an orientation of fibers and matrix material that responds to internal pressure changes by increasing or decreasing in length. The present invention further provides a mooring system, a marine riser system, and a pump assembly using such a connection member.

Features and Advantages

The invention provides a composite tubular for coupling two objects and methods for using such an apparatus in various applications. The composite tubular is designed such that there is no need to replace it due to a change in external operating conditions.

The composite tubular is inexpensive to manufacture, install and repair compared to similar conventional connectors. Depending upon the selection of matrix material for the composite tubular, the tubular may be stored on a spool or flattened and stored in a container. This sort of storage significantly reduces shipping costs, space constraints and manipulation and installation of the tubular.

The methods which use the composite tubular eliminate the need for large, complex, and expensive support equipment that is generally required to perform such methods. This results in a considerable cost savings over time.

The composite tubular can change its natural frequency to vortex induced vibrations when used as a structural tension member by varying the tubular's internal pressure. This feature is important to its long-term fatigue performance.

Additional features and advantages of the invention will be set forth in the description that follows, and in part will be apparent from the description, or may be learned in practice of the invention.

BRIEF DESCRIPTION OF THE DRAWINGS

The accompanying drawings, which are incorporated in and constitute a part of this specification, illustrate embodiments of the invention and, together with the description, serve to explain the features, advantages, and principles of the invention.

DETAILED DESCRIPTION OF THE PREFERRED EMBODIMENTS

Reference will now be made in detail to the present preferred embodiments of the invention, examples of which are illustrated in the accompanying drawings. The exemplary embodiment of this invention is shown in some detail, although it will be apparent to those skilled in the relevant art that some features which are not relevant to the invention may not be shown for the sake of clarity.

The present invention functions as a flexible solid-state single acting hydraulic cylinder in tension. The effective stroke of the cylinder is in the range of about 3 to about 8% of its over-all length. The cylinder is made of composite construction where the internal fibers are oriented to enhance the composite tubular's axial response to internal pressure when capped on the ends. Axially oriented fibers within the construction provide a physical limit to extension.

Circumferential fibers limit its increase in diameter and thus the cylinder's shortening stroke, thereby forming a contraction limit by controlling radial expansion of the sidewall.

Such a long flexible cylinder solves a number of applications, particularly in the marine environment and in a well. This includes vertical and taut leg mooring systems and long stroke plunger pump operation. Connection to an assortment of hydraulic supply sources (constant pressure or varying pressure) affects the behavior of the cylinder in tension. These tubular cylinders can be connected end to end and they may be braided or bundled for redundancy.

Figure 1B:
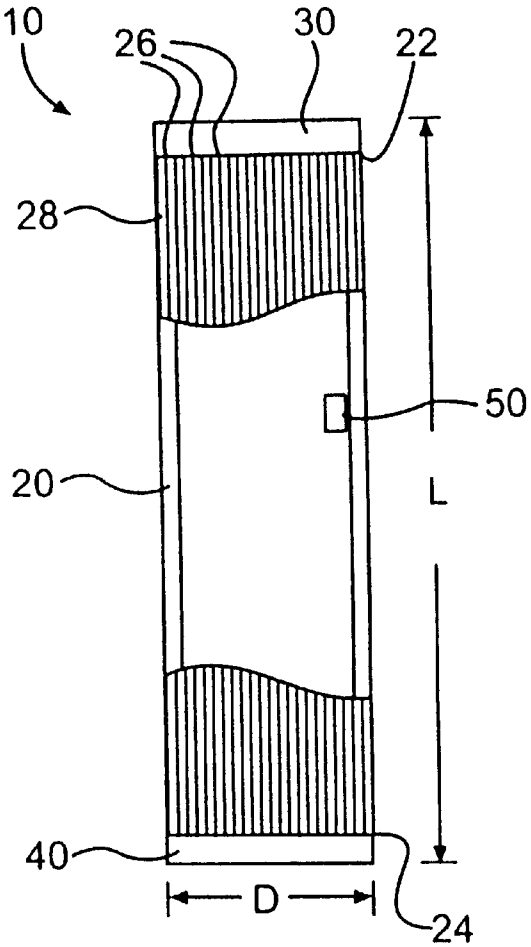
FIG. 1*b* is a partial section view of one embodiment of a composite tubular of the present invention with axially oriented fibers.

Referring first to FIG. 1, there is illustrated an exemplary embodiment of the present invention. A composite tubular generally designated by reference numeral 10 is shown. The composite tubular 10 comprises a sidewall 20 that has a first end 22, a second end 24, and a length L ($L_1$+$L_2$), a pressure control cap 30 coupled to one end of the sidewall 20 and an end cap 40 coupled to the other end of the sidewall 20.

The pressure control cap 30 is coupled to a pressure control device 32, described below in connection with FIGS. 9–11, in order to enable the composite tubular 10 to be pressurized. The composite tubular 10 can be pressurized with either liquid, gas, or a combination of the two. The end cap 40 is effective to maintain the internal pressure of the composite tubular 10.

The sidewall 20 comprises fibers 26 and matrix material 28 that are generally known to those of ordinary skill in the art. The fibers 26 are oriented within the sidewall 20 such that the length L changes with internal pressure changes. For example, when the internal pressure of the composite tubular 10 is increased, the diameter D of the tubular 10 will increase and the length L of the tubular 10 will decrease. Alternatively, when the internal pressure is decreased, the diameter D of the tubular 10 will decrease and the length L of the tubular 10 will increase. When the change in length L and diameter D occurs, there will be a net internal volume change. The cross sectional volume changes as the square of its diameter D while the axial length L change causes only a linear volume change. The desired percentage change in length L due to internal pressure change is approximately 3–8%. However, the orientation of the fiber 26 can be changed to realize virtually any percentage change in length.

Figure 3:
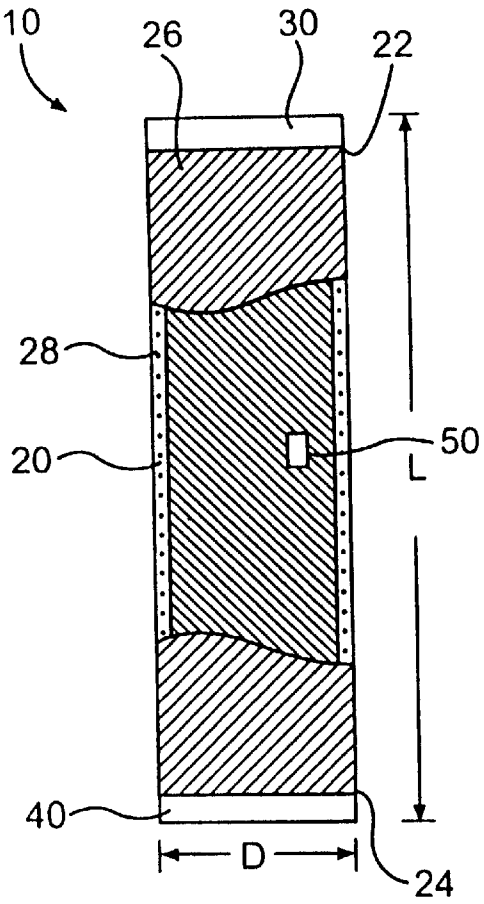
FIG. 3 is a partial section view of another embodiment of a composite tubular of the present invention with helically oriented fibers.

The fiber 26 in the sidewall 20 can be oriented either axially (FIG. 1), circumferentially (FIG. 2), or helically (FIG. 3) in a multi-layer composite construction in order to achieve desired length to internal pressure response and limits. It is preferred, for purposes of the present invention, to use a helical orientation for the fibers 26. The fiber 26 is selected to be a strong fiber with little axial elasticity (i.e. stretch). Preferred fibers include glass, carbon fiber and high strength steel wire. The lay-up length of the fiber 26 is a function of both the fiber's 26 pitch length $P_L$ and diameter D. Assuming the reinforcing fiber 26 maintains a constant length and, the tubular 10 were to shorten, for example, 5%, then the diameter D would change proportionally within the limits of the materials from which the tubular 10 is manufactured and the formula for the length of a helix. (Helix length=Square root of (pitch length squared+($\pi$* diameter) squared). The exact change in (helix) diameter due to pitch length $P_L$ change is dependent upon the ratio of pitch length $P_L$ to helix diameter of the reinforcing material. The ratio (or pitch angle $\alpha$) between pitch length $P_L$ and diameter is selected based upon the desired ratio between internal pressure and axial working load within the ability of matrix materials 28 to handle the required deformations. However, the 5% shortening of the helix pitch causes an increase in diameter of the helix and thus the tubular 10 (for pitch angles less than 60 degrees). This diameter D change causes a net volume change (increase) of the composite tubular 10.

The internal pressure, maximum tubular length L change, helical pitch length $P_L$ and diameter D are selected such that a pitch angle a producing acceptable matrix material 28 formation and tubular's internal volume change occurs. Specifying certain variables allows the other variables to be optimized in a pressure responding tubular 10 design.

Axial and circumferential reinforcing layers can be included in the composite tubular 10 structure to limit the maximum extension and contraction, respectively, of the tubular 10 due to internal pressure. Normally this extension is limited to a few percent of the overall length L. The external load required to extend or stretch the tubular 10 can be changed by controlling the internal pressure within the tubular 10.

Figure 9:
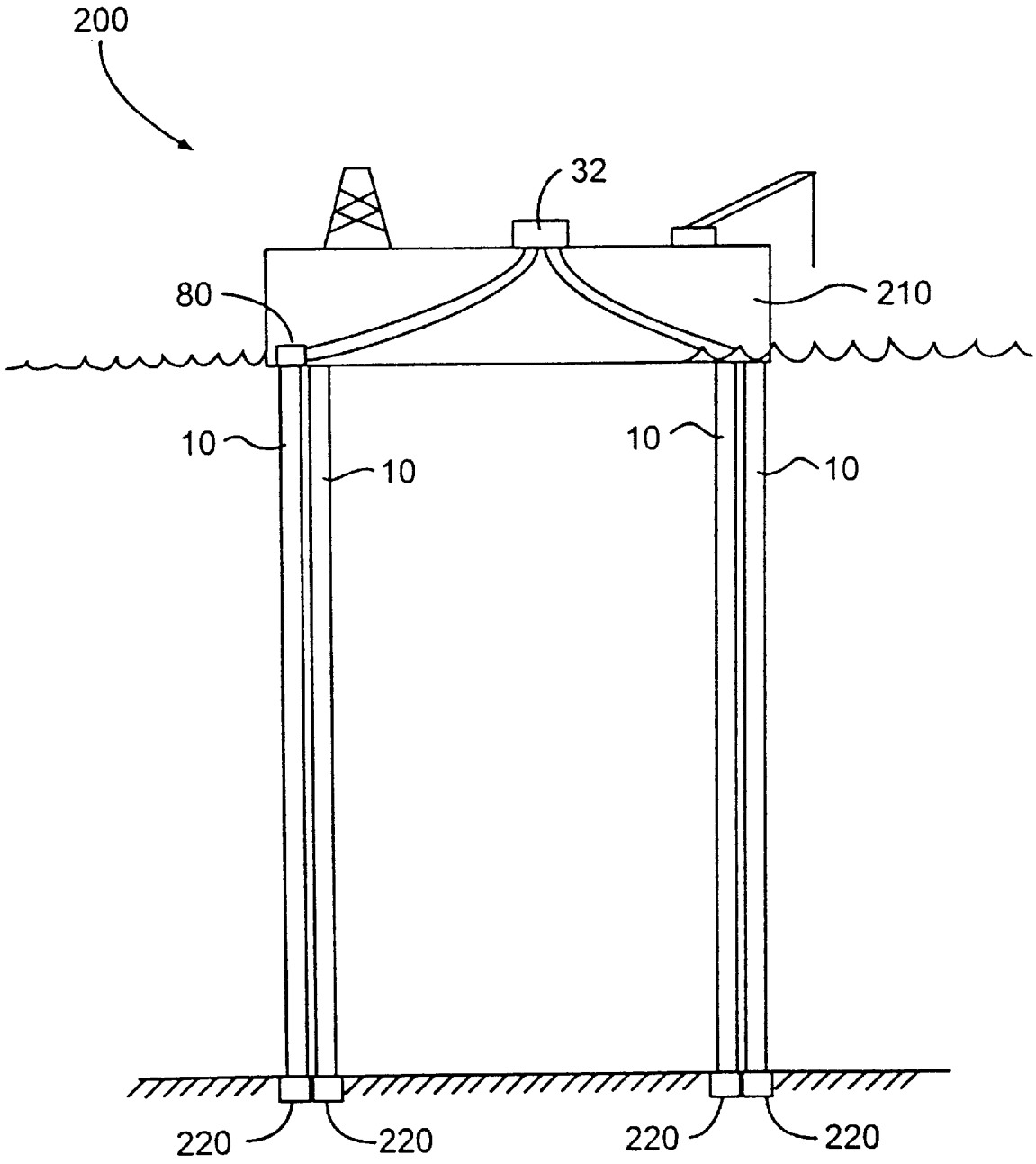
FIG. 9 is a side-elevation view of a vertical mooring system of the present invention.
Figure 10:
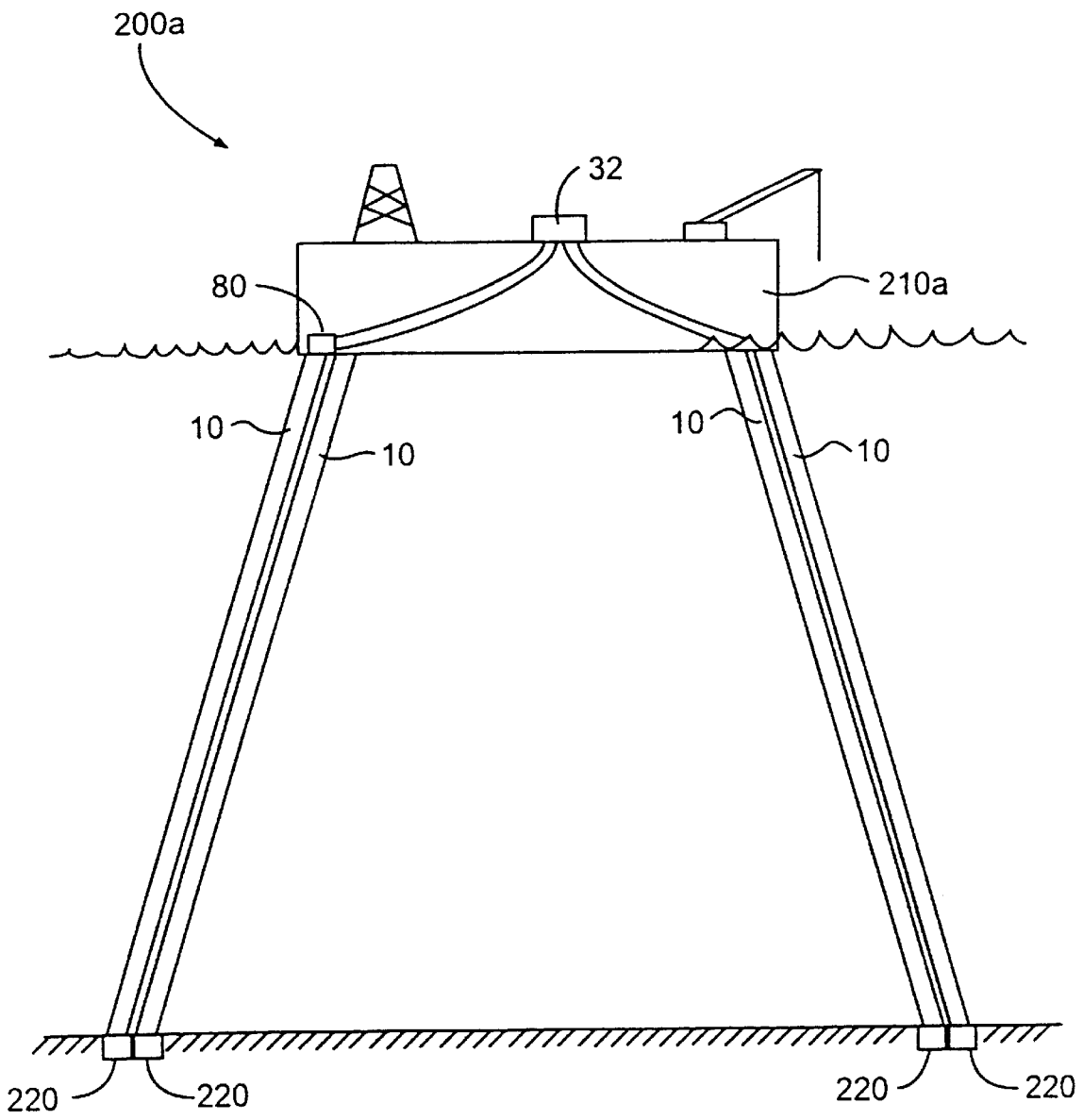
FIG. 10 is a side-elevation view of a taut leg mooring system of the present invention.
Figure 11:
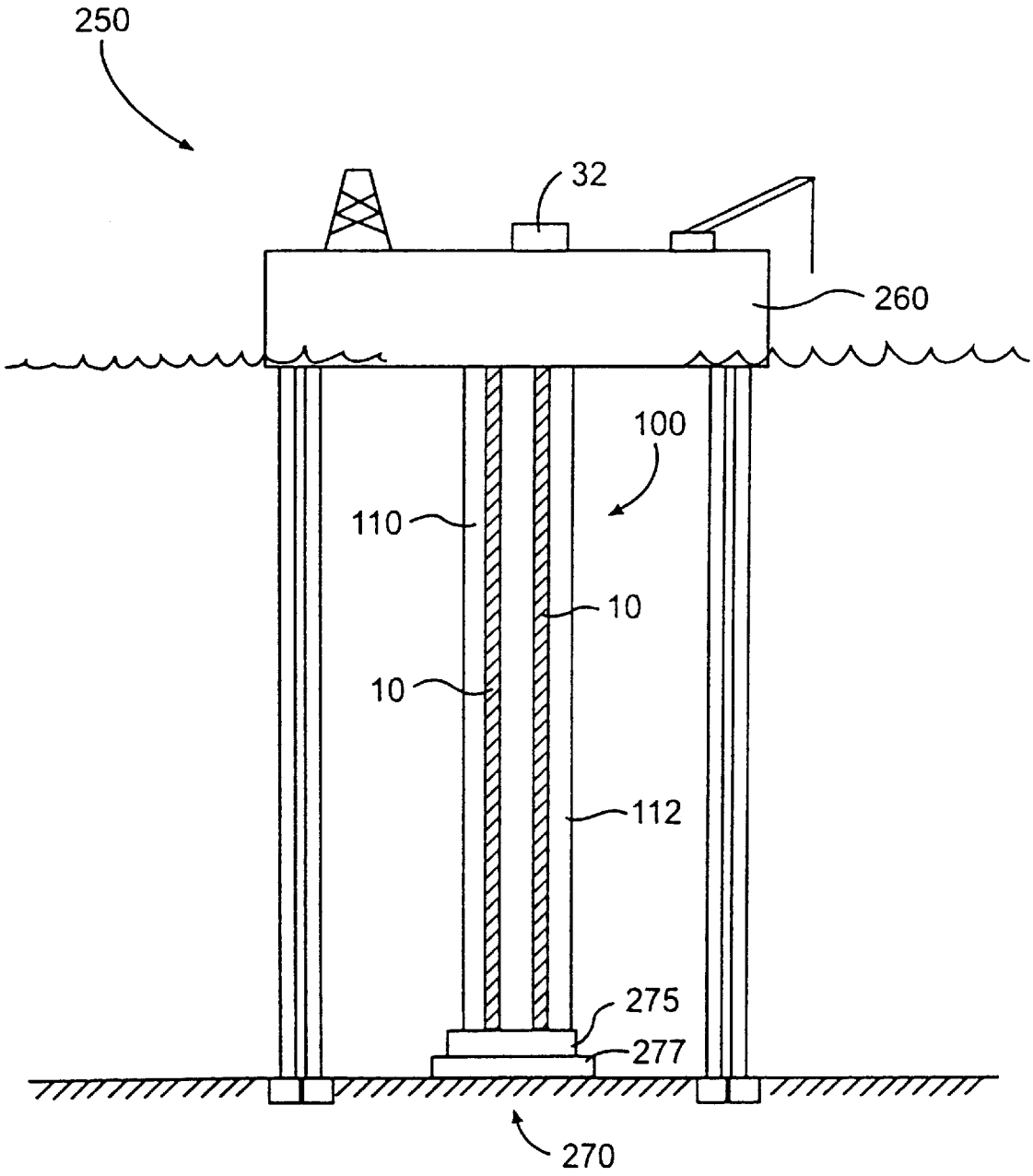
FIG. 11 is a side elevation view of a riser assembly of the present invention.

Pressure control is an external function and can be accomplished hydraulically several different ways via a pressure control device 32 (best seen in FIGS. 9–11). For example, a constant pressure hydraulic pump can maintain constant pressure within the tubular 10. The tubular 10 will have an extension versus external load that is essentially a step function when the tubular's 10 internal pressure is held constant. The external load at which this step occurs can be varied by adjusting the internal pressure which is then held constant. The ability of the tubular 10 to contain pressure may also be interpreted as an indication of the tubular's 10 integrity. This is an important aspect when used in mooring systems.

Length step functions in composite tubular 10 responses at a given pressure are useful in certain applications. However, another hydraulic pressure control circuit can cause the composite tubular 10 to respond similar to a spring. (Where external load=spring rate×extension). This is accomplished by putting an accumulator 80 in the circuit (see FIG. 9). The pressure change versus liquid volume within the accumulator 80 defines the accumulator's 80 pressure response as volume is forced from the composite tubular 10 into the accumulator 80 by external axial load changes in the composite tubular.

The matrix material 28 included in the sidewall 20 holds the fibers 26 together and provides for load sharing and equalization within the composite. The matrix material 28 preferably comprises elastomeric materials such that the composite tubular 10 is substantially flexible and may be flattened and reeled or flaked for compact storage. When the tubular 10 is spooled, the deployment and retraction of the tubular 10 is easily performed. The matrix material 28 may alternatively comprise a stiffer epoxy-like material in order to provide a somewhat more rigid structure that can be spooled similar to conventional pipe materials. The fibers 26 are protected within the matrix material 28 and do not self abrade against adjacent fibers 26 such as that which occurs with a typical rope structure.

The combination of a composite tubular 10, where the fiber 26 orientation maximizes the structural pressure response, working with selected hydraulic control circuits provides for adjusting the axial tension and spring rate of the composite tubular 10 and makes it useful for many applications.

Sensors 50, such as fiber optic sensors may be disposed within the sidewall 20 in order to measure the physical properties and behavior of the composite tubular 10. The sensors 50 measure effects such as strain, temperatures, and pressures distributed over the fibers 26. It is desirable to have single fiber optic sensors near the core of the tubular 10.

Figure 1A:
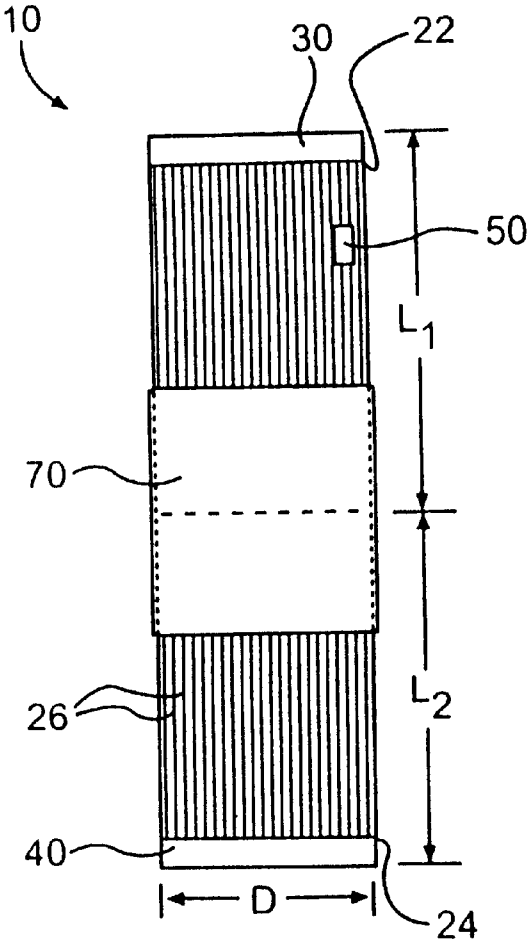
FIG. 1*a* is a side view of a composite tubular of the present invention with a connection member in place.
Figure 2:
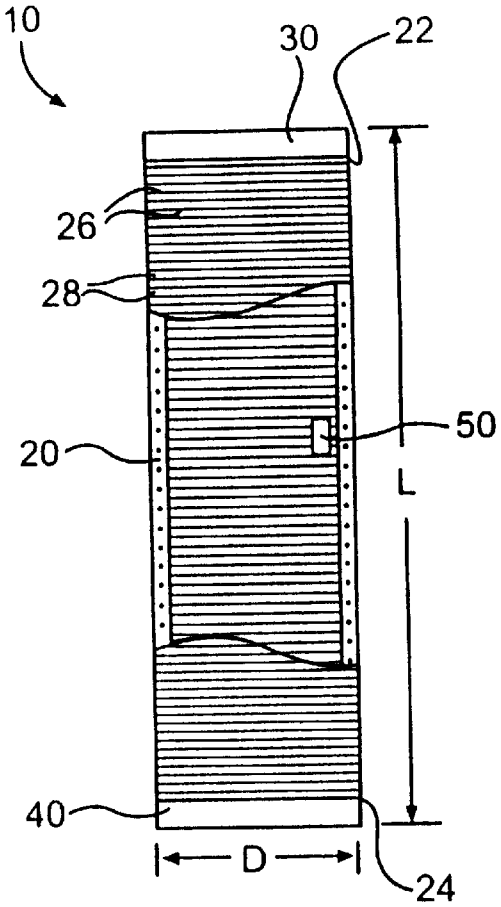
FIG. 2 is a partial section of view of another embodiment of a composite tubular of the present invention with circumferentially oriented fibers.

It is preferable for composite tubulars 10 to be configured so that they can be connected to one another end to end in the event that additional lengths are needed. A connection member 70 as shown in FIG. 1*a* is provided to effect such a connection Tubular 10 has a first length portion $L_1$ and a second length portion $L_2$ with connection member 70 coupling together $L_1$ and $L_2$. The axial strength of the connection member 70 must be at least the same as that of the composite tubulars 10 it is connecting in order to maintain the overall strength of the tubular 10. The connection member 70 is configured to allow passage of internal pressure within the length portions. The connection member 70 may also be used to repair a damaged tubular 10. The damaged section of the tubular 10 can be removed from the tubular 10 and a connection member 70 inserted to splice the resulting sections together. A suitable connection member is a Fiberspar Spoolable Production Tubing Connector available from Fiberspar Spoolable Products, Inc., Houston, Tex.

To more clearly describe the design of the composite tubular 10, the following example is given. It is to be understood that the details and calculations shown below are simplified to describe the primary factors involved in calculating pressure response of the composite tubular. As would be apparent to one of ordinary skill in the relevant art, other secondary factors may affect the calculation. This example should not represent any limitation on the present invention. Corresponding reference numerals will be used where appropriate.

The composite tubular 10 is designed to maximize the length L changing effect of pressure. The following are equations that describe the principles involved.

The axial load and working pressure to be used in the design of the composite tubular are assumed. For example:

Pressure=5,000 psi (max)

Axial Load=1,000,000 lbs. (max)

The design is for the maximum or ultimate load condition. This a similar concept to the breaking strength of a rope as used in vessel mooring applications.

Figure 4A:
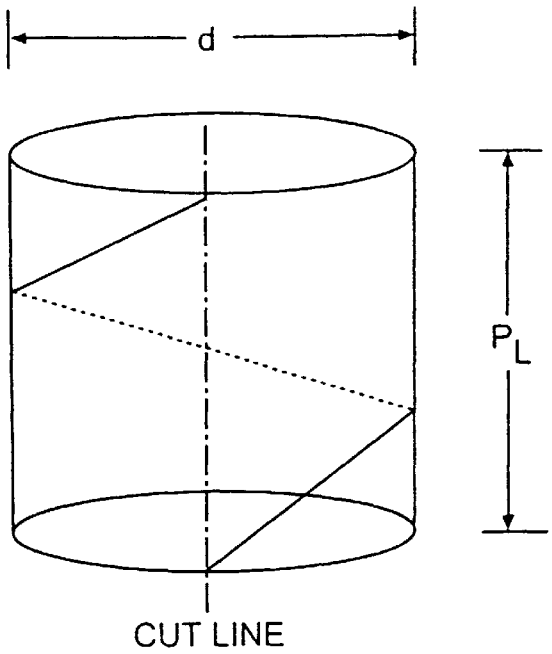
FIG. 4*a* is a representation of a unit length of a composite tubular.
Figure 4B:
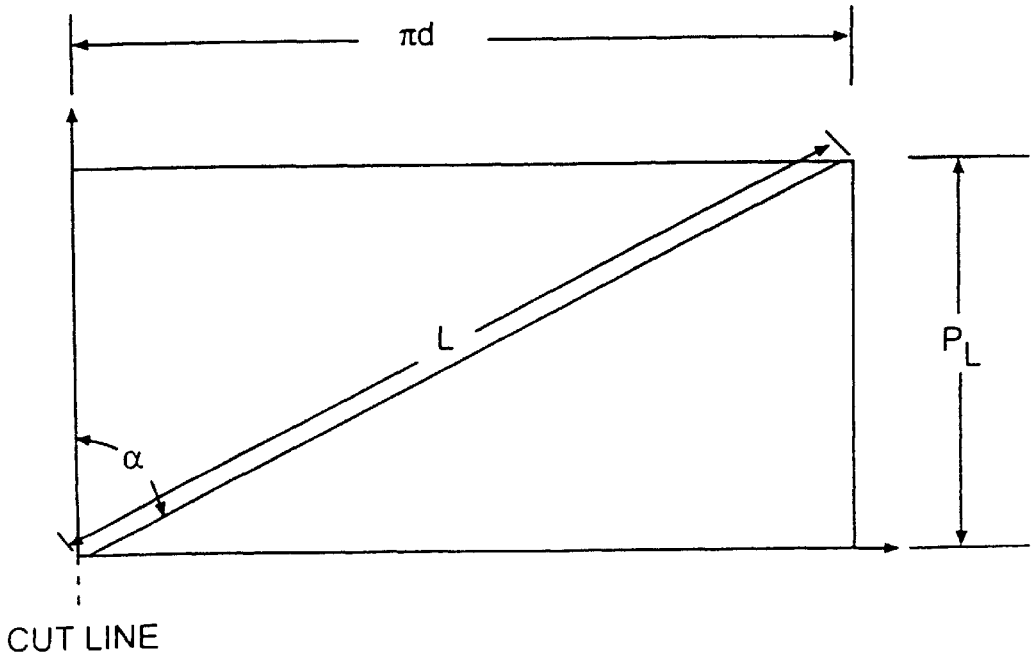
FIG. 4*b* is a representation of the unit length of a composite tubular in FIG. 4*a* in plan view showing the plane of the composite tubular sidewall.

The design is approached on a unit length basis. FIG. 4*a* is a representative unit length of a composite tubular 10 with one helically wound fiber 26 shown for example purposes. However, multiple fibers 26 in multiple layers are preferably used for the purposes of the present invention.

From geometry we know:

$$L = \sqrt{(\pi d)^2 + (P_L)^2}$$

$$\alpha = \tan^{-1}\frac{\pi d}{P_L}$$

Take the elemental volume and fill the tubular 10 with internal pressure ($P_R$). The hoop fiber load is then $$2Tension_{Hoop} = P_R d * \frac{P_L}{2}$$

$$Tension_{Hoop} = \frac{P_R d P_L}{4}$$

Since the Hoop Tension (due to internal pressure) is related to the Axial Load by the tangent of the Lay Angle,α, then:

$$Load_{Axial} = \frac{Tension_{Hoop}}{\text{Tan}\alpha} = \frac{P_R d P_L}{4\text{Tan}\alpha}$$

Substituting for Tan α

$$Load_{Axial} = \frac{P_R d P_L}{4\left(\frac{\pi d}{P_L}\right)} = \frac{P_R P_L^2}{4\pi}$$

Since we assume Axial Load (max) and internal pressure (max), the required Pitch Length is calculated.

$$P_L = \sqrt{\frac{4\pi(Load_{Axial})}{P_R}}$$

For any Axial Load, sufficient reinforcing material must be installed to carry the load.

Fiber Load=$[(\text{Load Axial})^2+(\text{Hoop Load})^2]^{1/2}$

This Fiber Load is divided by the unit strength of the fiber 26 to determine how much fiber is required.

Next, different values of a are substituted into the formulas and the resulting dimensions of the tubular 10 are calculated.

$$1.\ P_{L(\min)} = \sqrt{\frac{4\pi(AxialLoad)_{\max}}{P_R}}$$

$$2.\ d = \frac{(AxialLoad)4\text{Tan}\alpha}{P_R P_L}$$

Next, the internal fluid volume of the unit cylinder is calculated.

$$3.\ \text{Volume}=\tfrac{1}{4}\pi d^2(P_L)$$

These three equations are all based on assuming values for Axial Load, Internal Pressure and fiber lay-up.

One can also calculate the length of the reinforcing fiber 26 in the unit length.

$$L=[(P_L)^2+(\pi d^2)]^{1/2}$$

Due to the strength of the fiber 26, assume it remains almost constant in length while the tubular 10 responds to pressure.

Matrix material 28 controls the performance and fatigue properties of the composite tubular 10. Due to this material limitation, a maximum axial deformation of 5% at maximum load is assumed. Next, the change in diameter D and volume due to this 5% axial length L change and assumed reinforcement angle is calculated.

Figure 5:
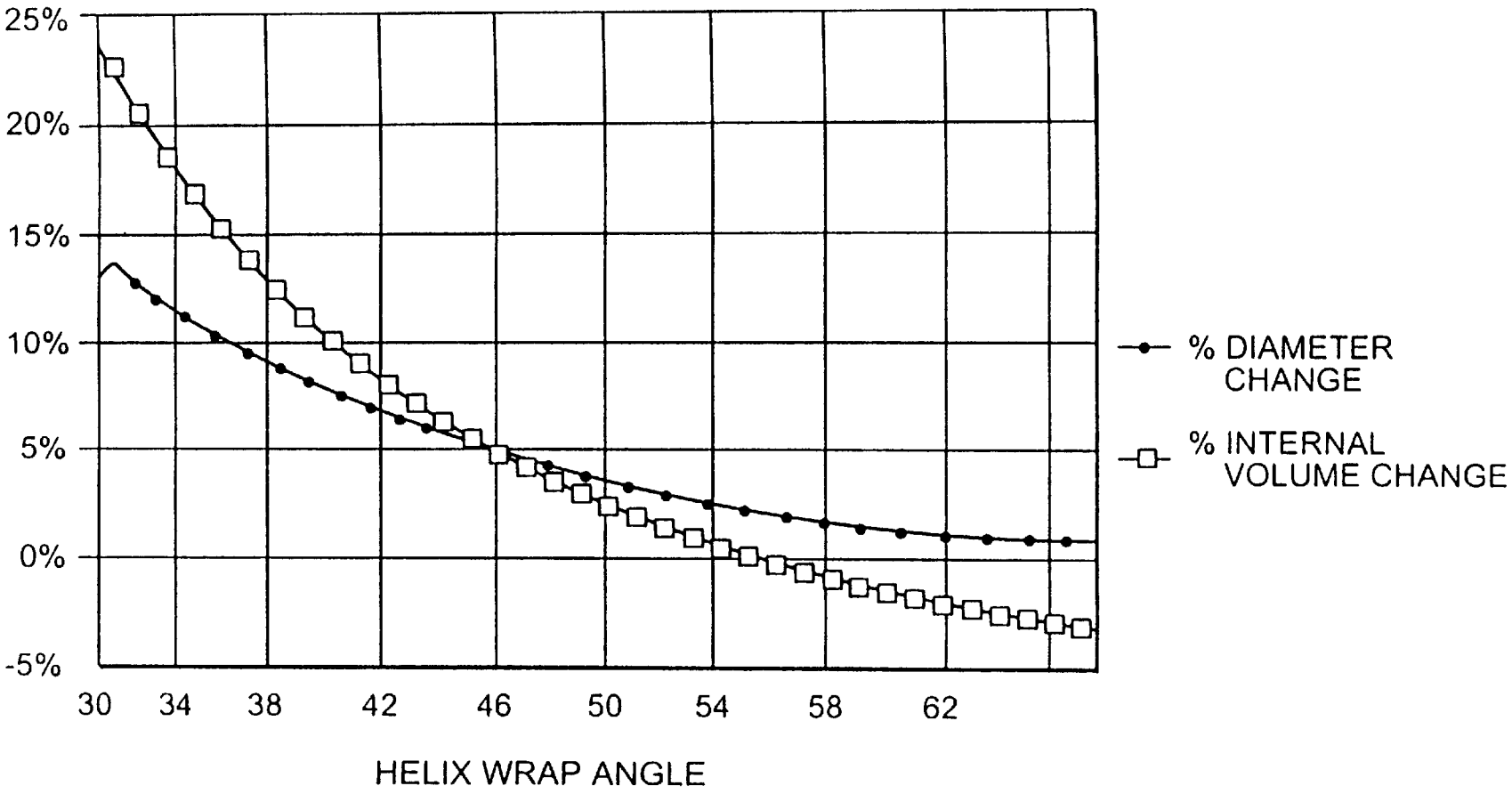
FIG. 5 is a graphic representation of composite tubular design features according to an embodiment of the present invention.

These equations were programmed into a spread sheet to allow investigation of several alternative models, the results of representative calculations are shown graphically in FIG. 5. FIG. 5 shows % diameter change and the % internal volume change as a function of helix wrap angle, or lay angle α. As an example of what is graphically depicted, the following results were achieved for a lay angle α of 45 degrees:

| | |
|---|---|
| Maximum Axial Load Desired (lbs.) | 1,000,000 |
| Maximum internal pressure desired (psi) | 5000 |
| Pitch Length (in.) | 50.133 |
| Internal diameter (in.) | 15.958 |
| Fiber Length (in.) | 70.898 |
| Change in Pitch Length as percentage decrease | 5% |
| New Pitch Length | 47.626 |
| New Internal Diameter | 16.718 |
| Percentage Internal Diameter Change | 5% |
| Initial Volume (in.$^3$) | 10026.51 |
| New Volume (in.$^3$) | 10453.89 |
| Percent Volume Change | 4.3% |

With reference now to FIGS. 6*a* through 8*b*, in another embodiment of the present invention, a plurality of the composite tubulars 10 described above can be arranged in bundles 100. The bundle 100 arrangement provides a redundancy in that it prevents losing all coupling capability in the event that one of the tubulars 10 fails in service. The composite tubulars 10 in the bundle 100 have the properties of the single composite tubular 10 described above. However, the tubulars 10 in the bundle 100 may be individually pressurized to perform distinct functions. For example, in a bundle 100 comprising six composite tubulars 10, three of them can be pressurized to achieve a decrease in the length L of those tubulars 10, and the other three can be internal pressure neutral to perform another function. Pressure neutral refers to tubular 10 designs which do not change length with varying internal pressures. This is essentially a conventional tubular design. It should be noted that the pressure of any of the tubulars 10 in the bundle 100 can be changed at any time in order to respond to external conditions.

Figure 6A:
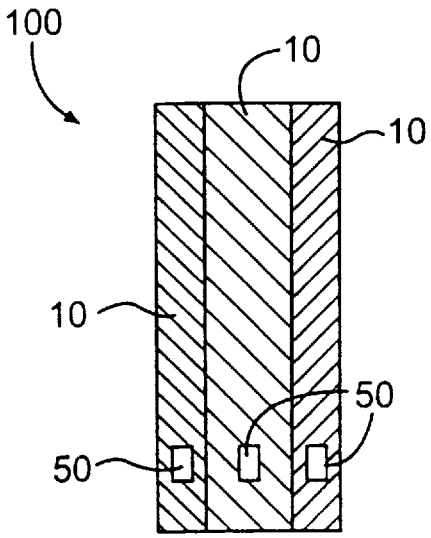
FIG. 6*a* is a side view of an axially aligned composite tubular bundle of the present invention.
Figure 6B:
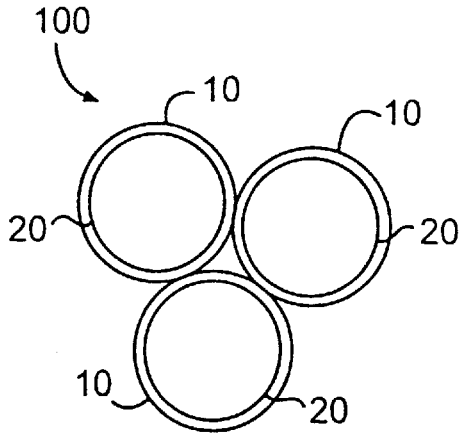
FIG. 6*b*. is a plan view of an axially aligned composite tubular bundle of the present invention.

The bundles 100 may be oriented in a variety of ways. In one embodiment of the present invention, as shown in FIGS. 6*a* and 6*b*, the bundle 100 of composite tubulars 10 is axially aligned such that the sidewalls 20 of each of the composite tubulars 10 is adjacent one another. The sidewalls 20 are coupled such that if one of the tubulars 10 failed, it would be easily removed or repaired.

Figure 7A:
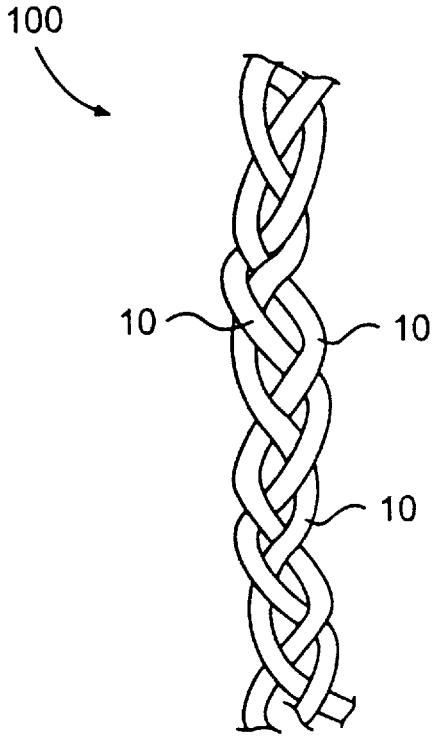
FIG. 7*a* is a side view of a braided composite tubular bundle of the present invention.
Figure 7B:
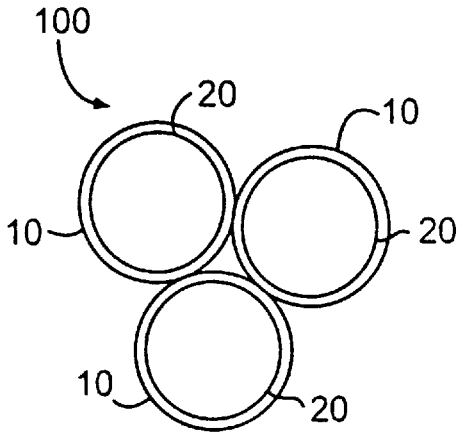
FIG. 7*b*. is a plan view of a braided composite tubular bundle of the present invention.

In another embodiment of the present invention, as shown in FIGS. 7*a* and 7*b*, the bundle 100 of composite tubulars 10 is oriented such that the composite tubulars 10 are braided. It is desirable that the length of the braid weave be long such that the tubulars 10 do not interfere with one another during expansion and contraction.

Figure 8A:
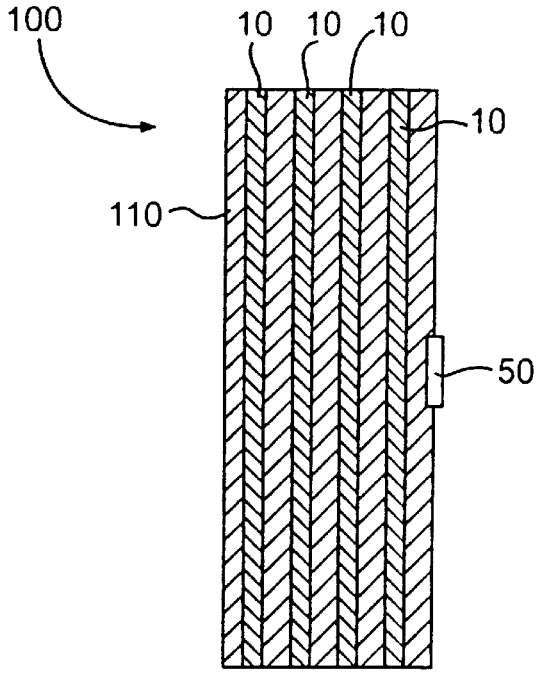
FIG. 8*a* is a side view of a composite tubular bundle with an internal core of the present invention.
Figure 8B:
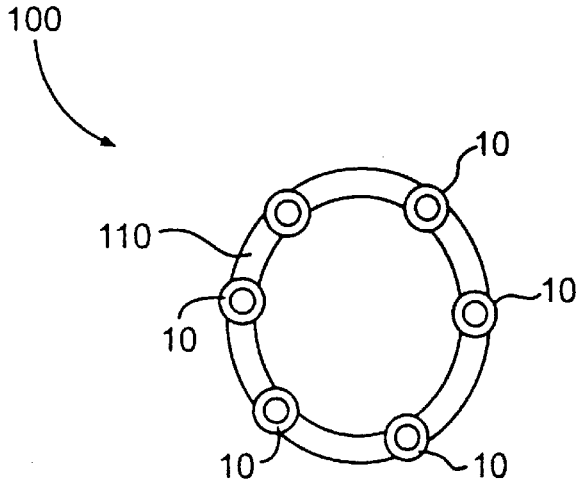
FIG. 8*b*. is a plan view of a composite tubular bundle with an internal core of the present invention.

In yet another embodiment of the invention, as shown in FIGS. 8*a* and 8*b*, there is a central core tubular 110 that comprises a flexible material. The composite tubulars 10 are axially or helically coupled to the perimeter of the central core tubular 110.

The composite tubulars 10 described above, either singly or in bundles 100, may be utilized in numerous applications. In another aspect of the invention shown in FIG. 9, the composite tubulars 10 may be used in a vertical mooring system 200, as well as in a method of mooring. The composite tubular 10 is installed as a vertical mooring tendon between the platform 210 and a mooring base 220. Alternatively, a bundle 100, as shown in FIGS. 6*a* through 8*b*, may be used as a mooring tendon between platform 210 and mooring base 220. The platform 210 and mooring base 220 are of the variety know to those of ordinary skill in the relevant art.

As described above, the internal pressure of the composite tubular 10 can be changed through the use of pressure control device 32. The pressure control device 32 in this application is preferably located on the platform 210 to facilitate operation. The pressure control device 32 is connected to pressure control cap 30 of the composite tubulars 10.

An increase in the internal pressure of the tubular 10 causes the length L of the tubular 10 to decrease as previously described and will draw the platform 210 down into the water to its eventual working draft during initial installation. While at this working draft, it is possible to adjust the pressure, and thus the respective spring rates, within each composite tubular 10. Such a pressure adjustment capability allows for active mooring management. For example, the present invention allows the composite tubulars 10 on the upwind side of the platform 210 to have a different spring rate than those on the downwind side. It is also desirable for the spring rates of the composite tubulars 10 to be different for storm conditions than for routine operating conditions. This can be achieved in the present invention by adjusting the internal pressure in the tubular(s) 10. In the event that vortex induced vibrations occur within the vertical mooring system 200, the internal pressure of the tubulars 10 can be changed to adjust the natural frequency and minimize such vibrations to reduce any detrimental effects. In the event that a bundle 100 of composite tubulars 10 is used to form the mooring tendons, similar adjustments to those described above can be made. Additionally, the pressure of each of the composite tubulars 10 which makes up the bundle 100, can be individually pressurized such that the internal pressure of each of the tubulars 10 is the same or different.

Regardless of whether single tubulars 10 or bundles 100 are used, the spring rate of the mooring tendon must be sufficiently high so that the mooring loads of the platform 210 are matched. The platform 210 requires significant load to pull it to its operating draft. Thus, the pressure is adjusted to provide the desired vertical mooring load in each tubular 10. Attachment of an accumulator 80 to the tubular 10 holds internal pressure constant, thus a constant vertical load allows small heave displacements of the platform 210 in response to the environment. Alternatively, allowing the internal pressure to vary (by coupling tubular 10 to pressure control device 32) within the tubular 10 provides the platform 210 with a stiff mooring member. Thus, it is to be understood that accumulator 80 shown in FIG. 9 can be coupled to one or more tubulars 10 depending upon the desired response.

In a manner similar to the vertical mooring system 200 shown in FIG. 9, the composite tubulars 10 can be used in a taut-leg mooring system 200*a* as shown in FIG. 10. A taut-leg mooring system 200*a* is an inclined and radial array of composite tubulars 10 extending between the mooring bases 220*a* and the floating platform 210*a*. The internal pressure within the composite tubular 10 controls the tension at which the composite tubular 10 extends. Active internal pressure management within each taut-leg mooring system tubular 10 provides control of the taut-leg mooring system 200*a* performance as the external environmental conditions change. All of the same features that exist for the vertical mooring system 200 also exist for the taut-leg mooring system 200*a* as well.

The composite tubulars 10 are easily repaired and, when an elastomeric matrix material 28 is used, can be easily reeled in and stored on a spool. The composite tubulars 10 are also readily deployed. They can be released into the water with the mooring base 220 attached and then pressurized such that the tubular 10 is stiff enough to effectively deploy the mooring base 220. Additionally, the internal pressure of the composite tubulars 10 can be monitored to ensure proper operation. For example, if the internal pressure of one of the tubulars 10 unexpectedly decreased, that would be an indicator of pending tubular 10 failure. This feature holds true for any of the embodiments described herein.

In another embodiment of the invention shown in FIG. 11, the composite tubulars 10 described above may be used in a riser system 250, as well as a method of operating a riser system 250. The riser system 250 typically uses bundle 100 of composite tubulars 10, as shown in FIGS. 8*a* and 8*b* and described above, which is connected between a platform 260 and a base connection member 270. There is an internal core tubular 110 which has a sidewall 112 which defines a cavity. Multiple individual composite tubulars 10, as described above, are attached to the perimeter of the internal core tubular 110. The composite tubulars 10 can alternatively be embedded in the sidewall 112 of the internal core tubular 110. The internal pressure of at least one of the composite tubulars 10 may be increased or decreased to cause a decrease or increase in length L of the tubular 10 assembly. Alternatively, some of the tubulars 10 may be pressure neutral to serve as utility lines or guides.

The internal core tubular 110 is substantially a flexible fabric material, but it needs to contain pressures as large as 2,000 psi so strong glass or carbon fiber material is desired to reinforce the material of the internal core tubular 110. The internal core tubular 110 is preferably internally pressurized with drilling mud or other production fluids to ensure that it remains inflated and also gives the riser assembly 250 sufficient mass to minimize small horizontal motions. The internal core tubular 110, since it is essentially fabric, preferably has an impermeable fluid barrier such as neoprene, urethane, and polyethylene, in order to contain the internal fluids. The material which serves as the internal barrier must be strong enough to resist damage from tools, equipment, and rotating drill piping passing through the inside of the internal core tubular. Since the riser is basically an elastomeric and fabric construction, the ends can be reinforced to attach to the platform 260 and the seafloor mounted Blow Out Prevention (BOP) 275 and Lower Marine Riser Package (LMRP) 277 attachment points which make up the base connection member 270. BOP 275 and LMRP 277 are known to those of ordinary skill in the relevant art and are the components which allow the marine riser assembly to remain safely connected to the ocean floor. The tensioned riser connection between BOP 275 and LMRP 277 allows the riser and LMRP 277 to safely lift away from the ocean floor without causing damage to the riser or the base connection member 270 in the event of an emergency disconnection. This composite riser eliminates the need for a separate flexible joint currently used for rigid pipe connections. This lower riser connection may require the installation of a wear prevention bushing to prevent drill pipe rotational wear damage to the equipment should the platform 260 not be in position vertically above the base connection member 270.

The plurality of composite tubulars 10 surrounding the internal core tubular 110 are similar to those described above and respond to pressure in the same manner. At least one of the composite tubulars 10 can be pressure neutral as described above such that it can be used as a utility line or guide. A utility line is essentially a line that is used to either serve as a conduit for production fluid or a guide sleeve for typical choke and kill lines. The choke and kill lines are used for high pressure control in a well together with the BOP 275 and the LMRP 277. These choke and kill lines are known to those of ordinary skill in the relevant art. The remaining composite tubulars 10 are pressurized to respond to environmental conditions, while remaining flexible enough to respond to the vertical motions of the platform 260. The composite tubulars 10 provide the stiffness required for the riser system 250 to resist the marine environment.

Since both the internal core tubular 10 and the surrounding composite tubulars 10 are preferably comprised of flexible matrix material 28, the riser system 250 can be reeled in and stored on a spool. Such a construction allows the system to be rapidly deployed and recovered. The riser can be manufactured in several discrete lengths such that when segments become damaged, they can be easily removed from service and replaced.

Figure 12:
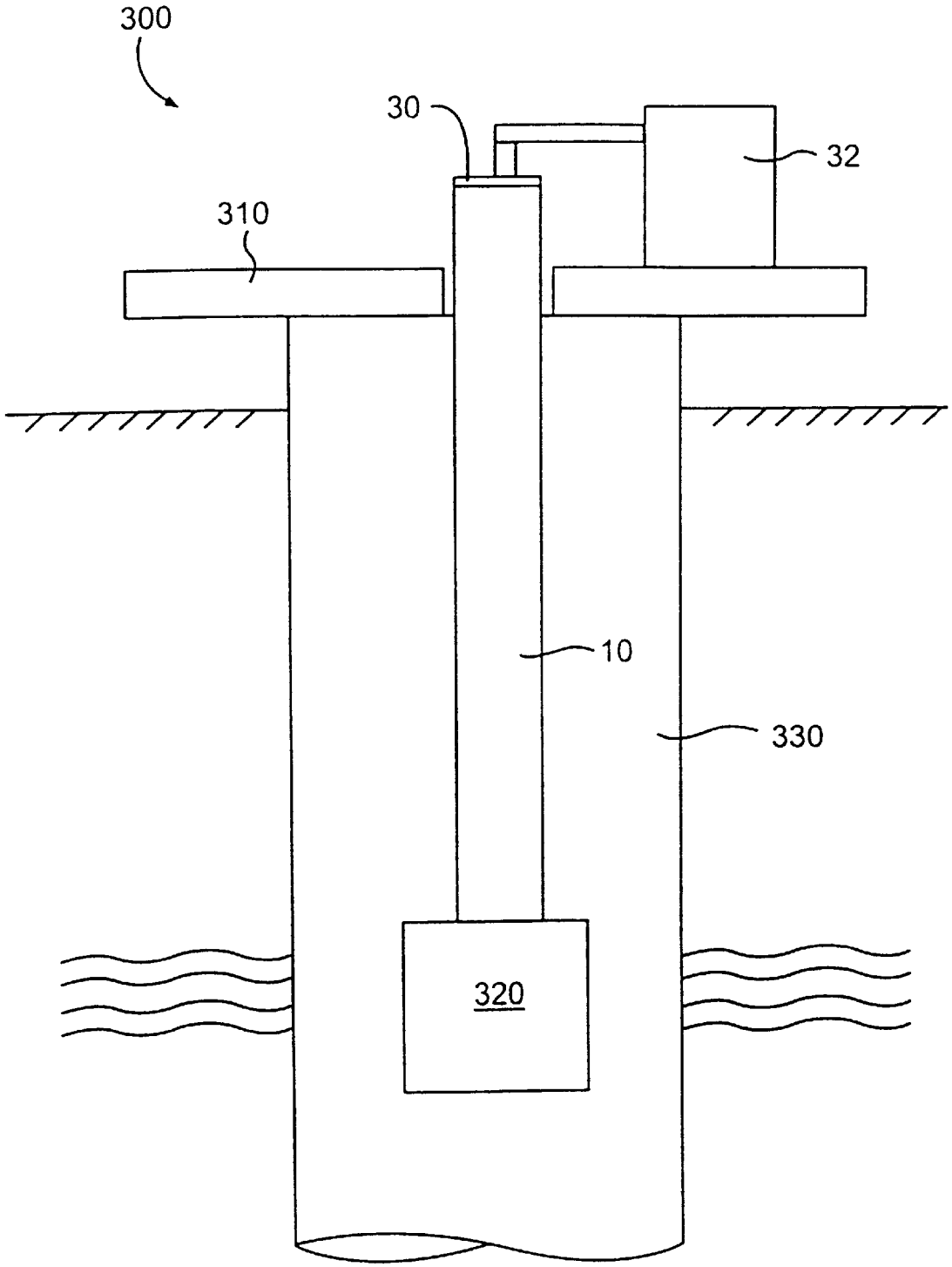
FIG. 12 is a partial section view of a pump assembly of the present invention.

In another embodiment of the invention shown in FIG. 12, a composite tubular 10 may be used in a pump assembly 300, as well as in a method of operating a pump assembly 300. The composite tubular 10 is connected at one end to a pump 320 and at the other end to a surface platform 310 spaced apart from the pump 320. A pressure control device 32 is disposed on the surface platform 310 and is coupled to pressure control cap 30 of the composite tubular 10 in order to achieve cyclical pressure changes. The pressure of the composite tubular 10 is cyclically decreased and increased to cause the length L of the sidewall 20 of the tubular 10 to increase and decrease respectively.

The cyclical pressure changes, which are preferably sinusoidal in variation, cause the composite tubular 10 to proportionally increase and decrease in length. The composite tubular 10, which is connected to the pump 320, drives the pump 320 in order to extract production fluid. The composite tubular 10 preferably serves as an actuator for the pump 320 and does not carry production fluid. The production fluid is pumped out through the annular space 330 surrounding the tubular as shown in FIG. 11. It would be obvious to one of ordinary skill in the relevant art to modify this invention such that the tubular 10 serves as a conduit for production fluid. In a downhole pump assembly operation, which is known to those of ordinary skill in the relevant art, it is preferred that the external surface of the composite tubular 10 is provided with an external protective wear coating such as urethane or nylon. This coating prevents abrasion wear of the production tubing and the composite tubular 10 within the well.

The fact that the composite tubular 10 comprises flexible material, the pump 320 and the composite tubular 10 can be easily deployed and retrieved. This facilitates repair of both the tubular 10 and the pump 320 itself.

As described above, and as shown in the above example, the present invention provides a simple apparatus for connecting objects that are separated from one another. It should be apparent that the present invention may be used to lower equipment costs, operating costs, shipping costs, and repair costs and to simplify the mooring of drilling platforms, the use and operation of riser assemblies, and the use and operation of pump assemblies.

Conclusion

While various embodiments of the present invention have been described above, it should be understood that they have been presented by way of example only, and not limitation. Thus, the breadth and scope of the present invention should not be limited by any of the above-described exemplary embodiments, but should be defined only in accordance with the following claims and their equivalents.

What is claimed is:

1. A composite tubular comprising:

a sidewall having a length between a first end and a second end, said sidewall being solid and defining a cavity so as to be capable of substantially maintaining a fluid therein, wherein said sidewall comprises fibers integral with a matrix material, and wherein said fibers comprise fibers selected from the group consisting of helical fibers helically wound between said first end and said second end, axial fibers extending axially between said first end and said second end, and circumferential fibers circumferentially wound between said first end and said second end, said fibers thereby being oriented such that an increase in the internal pressure of said composite tubular is effective to cause said length of said sidewall to decrease, and a decrease in said internal pressure is effective to cause said length of said sidewall to increase;

a pressure control cap coupled to one of said first and second ends, wherein said pressure control cap enables said internal pressure of said composite tubular to be changed; and an end cap coupled to the other of said first and second ends, wherein said end cap is effective to maintain said internal pressure.

2. A composite tubular as in claim 1, wherein said matrix material comprises elastomeric material.

3. A composite tubular as in claim 1, wherein said matrix material comprises epoxy material.

4. A composite tubular as in claim 1, further comprising:

a sensor disposed in said sidewall.

5. A composite tubular as in claim 4, wherein said sensor is a fiber optic sensor.

6. A composite tubular as in claim 1, further comprising:

a pressure control device coupled to said pressure control cap, wherein said pressure control device is configured to change said internal pressure of said composite tubular.

7. A composite tubular as in claim 1, wherein said fluid is a gas.

8. A composite tubular as in claim 1, wherein said fluid is a liquid.

9. A composite tubular as in claim 1, wherein said increase or decrease in said length of said sidewall is proportional to said decrease or increase in said internal pressure of said composite tubular.

10. A composite tubular as in claim 9, wherein said increase or decrease in said length of said sidewall is between about 3 percent and about 8 percent.

11. A composite tubular as in claim 1, further comprising:

a connection member, wherein said composite tubular comprises at least two length portions between said first and second ends, said connection member coupling together said at least two length portions and configured to allow passage of said fluid between said at least two length portions.

12. A mooring system comprising:

a platform;

a mooring base;

a composite tubular extending between said platform and said mooring base, said composite tubular having a sidewall having a length between a first end and a second end, said sidewall being solid and defining a cavity so as to be capable of substantially maintaining a fluid therein, wherein said sidewall comprises fibers integral with a matrix material, and wherein said fibers comprise fibers selected from the group consisting of helical fibers helically wound between said first end and said second end, axial fibers extending axially between said first end and said second end, and circumferential fibers circumferentially wound between said first end and said second end, said fibers thereby being oriented such that an increase in the internal pressure of said composite tubular is effective to cause said length of said sidewall to decrease, and a decrease in said internal pressure is effective to cause said length of said sidewall to increase;

a pressure control cap coupled to one of said first and second ends, wherein said pressure control cap enables said internal pressure of said composite tubular to be changed; and an end cap coupled to the other of said first and second ends, wherein said end cap is effective to maintain said internal pressure, wherein said pressure control cap is coupled to one of said platform and said mooring base and said end cap is coupled to the other of said platform and said mooring base.

13. A mooring system as in claim 12, wherein said matrix material comprises elastomeric material.

14. A mooring system as in claim 12, wherein said matrix material comprises epoxy material.

15. A mooring system as in claim 12, further comprising:

a sensor disposed in said sidewall.

16. A mooring system in claim 12, wherein said sensor is a fiber optic sensor.

17. A mooring system as in claim 12, further comprising:

a pressure control device coupled to said pressure control cap, wherein said pressure control device is configured to change said internal pressure of said composite tubular.

18. A mooring system as in claim 12, wherein said fluid is a gas.

19. A mooring system as in claim 12, wherein said fluid is a liquid.

20. A mooring system as in claim 12, wherein said increase or decrease in said length of said sidewall is proportional to said decrease or increase in said internal pressure of said composite tubular.

21. A mooring system as in claim 20, wherein said increase or decrease in said length of said sidewall is between about 3 percent and about 8 percent.

22. A mooring system as in claim 12, further comprising:

a connection member, wherein said composite tubular comprises at least two length portions between said first and second ends, said connection member coupling together said at least two length portions and configured to allow passage of said fluid between said at least two length portions.

23. A mooring system as in claim 12, further comprising:

an accumulator coupled to said composite tubular, said accumulator being effective to hold said internal pressure of said composite tubular constant, thereby allowing a constant axial load applied to said composite tubular to cause or resist displacement of said platform.

24. A method of mooring comprising:

increasing an internal pressure of a composite tubular coupled between a platform and a mooring base, the composite tubular having a length between a first end and a second end, and being solid so as to be capable of substantially maintaining a fluid therein, the composite tubular comprising fibers integral with matrix material, and wherein said fibers comprise fibers selected from the group consisting of helical fibers helically wound between said first end and said second end, axial fibers extending axially between said first end and said second end, and circumferential fibers circumferentially wound between said first end and said second end, said fibers thereby being oriented such that an increase in the internal pressure of said composite tubular is effective to cause said length of said sidewall to decrease, and a decrease in said internal pressure is effective to cause said length of said sidewall to increase; thereby shortening the length of the composite tubular and drawing the platform to its working draft.

25. A method of mooring as in claim 24, said method further comprising:

adjusting the internal pressure of the composite tubular in response to operating conditions, thereby adjusting the spring rate of the composite tubular to allow the platform to respond to an applied load.

26. A method of mooring as in claim 25, wherein a plurality of composite tubulars are coupled between the platform and the mooring base, and wherein said adjusting step is carried out so that the internal pressure of each of the plurality of composite tubulars is the same.

27. A mooring system as in claim 12, wherein said composite tubular is one of a plurality of composite tubulars configured into a composite tubular bundle, and wherein said plurality of composite tubulars are axially aligned and said sidewalls are adjacent one another.

28. A mooring system as in claim 12, wherein said composite tubular is one of a plurality of composite tubulars configured into a composite tubular bundle, and wherein said plurality of composite tubulars are braided to form the bundle.

29. A mooring system as in claim 12, wherein said composite tubular is one of a plurality of composite tubulars configured into a composite tubular bundle, and wherein said plurality of composite tubulars are coupled to form a perimeter about a central core.

30. A riser system comprising:

a platform;

a base connection member;

a composite tubular bundle extending between said platform and said base connection member, said composite tubular bundle comprising:

an internal core tubular having a sidewall having a length between a first and a second end, said sidewall defining a cavity having an internal surface and an external surface, said first end being coupled to said platform, said second end being coupled to said base connection member, a plurality of composite tubulars circumferentially coupled about said external surface of said internal core tubular, each of said composite tubulars having a sidewall having a length between a first end and a second end, said sidewall being solid and defining a cavity so as to be capable of substantially maintaining a fluid therein, wherein said sidewall comprises fibers integral with matrix material, and wherein said fibers comprise fibers selected from the group consisting of helical fibers helically wound between said first end and said second end, axial fibers extending axially between said first end and said second end, and circumferential fibers circumferentially wound between said first end and said second end, said fibers thereby being oriented such that an increase in the internal pressure of said composite tubular is effective to cause said length of said sidewall to decrease, and a decrease in said internal pressure is effective to cause said length of said sidewall to increase, a pressure control cap coupled to one of said first and second ends, wherein said pressure control cap enables said internal pressure of said composite tubular to be changed, and an end cap coupled to the other of said first and second ends, wherein said end cap is effective to maintain said internal pressure; and wherein said pressure control cap is coupled to one of said platform and said base connection member, and said end cap is coupled to the other of said platform and said base connection member.

31. A riser system as in claim 30, wherein said internal core tubular consists of at least one of glass fiber, carbon fiber, high strength wire, and steel tubular.

32. A riser system as in claim 30, wherein said internal core tubular is provided with a fluid barrier on said internal surface.

33. A riser system as in claim 32, wherein said fluid barrier consists of at least one of neoprene, urethane, and polyethylene.

34. A riser system as in claim 30, wherein said plurality of composite tubulars are helically coupled to said external surface of said internal core tubular.

35. A riser system as in claim 30, wherein said plurality of composite tubulars are axially coupled to said external surface of said internal core tubular.

36. A riser system as in claim 30, wherein at least one of said plurality of composite tubulars is provided with a guide sleeve extending from said first end to said second end, said guide sleeve adapted to guide objects from said platform to said base connection member.

37. A riser system as in claim 30, wherein said composite tubular bundle further comprises at least one pressure neutral tubular member, wherein said pressure neutral tubular member does not change length with a varying internal pressure.

38. A method of operating a riser system comprising:

adjusting an internal pressure of at least one of a plurality of composite tubulars in response to operating conditions, the plurality of composite tubulars being circumferentially coupled to an external surface of an internal core tubular, wherein one end of the internal core tubular is coupled to a platform and another end of the internal core tubular is coupled to a base connection member, wherein each of the composite tubulars is solid so as to be capable of substantially maintaining a fluid therein, wherein each of the composite tubulars comprises fibers integral with matrix material, and wherein said fibers comprise fibers selected from the group consisting of helical fibers helically wound between said first end and said second end, axial fibers extending axially between said first end and said second end, and circumferential fibers circumferentially wound between said first end and said second end, said fibers thereby being oriented such that an increase in the internal pressure of said composite tubular is effective to cause said length of said sidewall to decrease, and a decrease in said internal pressure is effective to cause said length of said sidewall to increase, thereby changing the length and the stiffness of the at least one of the plurality of composite tubulars.

39. A pump assembly comprising:

a pump;

a platform spaced apart from said pump; and a composite tubular, disposed between and coupled to said pump and to said platform, said composite tubular having a sidewall having a length between a first end and a second end, said sidewall being solid and defining a cavity so as to be capable of substantially maintaining a fluid therein, wherein said sidewall comprises fibers integral with matrix material, and wherein said fibers comprise fibers selected from the group consisting of helical fibers helically wound between said first end and said second end, axial fibers extending axially between said first end and said second end, and circumferential fibers circumferentially wound between said first end and said second end, said fibers thereby being oriented such that an increase in the internal pressure of said composite tubular is effective to cause said length of said sidewall to decrease, and a decrease in said internal pressure is effective to cause said length of said sidewall to increase, wherein said decrease and increase in said length of said sidewall is effective to drive said pump;

a pressure control cap coupled to one of said first and said second ends, wherein said pressure control cap enables said internal pressure of said composite tubular to be changed; and an end cap coupled to the other of said first and second ends and further coupled to said pump, wherein said end cap is effective to maintain said internal pressure.

40. A pump assembly as in claim 39, wherein said matrix material comprises elastomeric material.

41. A pump assembly as in claim 39, wherein said matrix material comprises epoxy material.

42. A pump assembly as in claim 39, further comprising:

a pressure control device disposes on said platform, said pressure control device being coupled to said pressure control cap, thereby cyclically controlling said internal pressure of said composite tubular.

43. A pump assembly as in claim 39, wherein said increase or decrease in said length of said sidewall is proportional to said decrease or increase in said internal pressure of said composite tubular.

44. A pump assembly as in claimed 43, wherein said increase or decrease in said length of said sidewall is between about 3 percent and about 8 percent.

45. A pump assembly as in claim 39, further comprising:

a connection member, wherein said composite tubular comprises at least two length portions between said first and second ends, said connection member coupling together said at least two length portions and configured to allow passage of said fluid between said at least two length portions.

46. A pump assembly as in claim 39, wherein said composite tubular comprises a substantially flexible matrix material, whereby said composite tubular is adapted to be stored on a spool.

47. A pump assembly as in claim 39, wherein said composite tubular further comprises an external protective wear coating.

48. A pump assembly as in claim 47, wherein said external protective wear coating consists of at least one of nylon and urethane.

49. A method of operating a pump assembly, comprising:

cyclically decreasing and increasing an internal pressure of a composite tubular, the composite tubular having a sidewall having a length between a first end and a second end, said sidewall being solid and defining a cavity so as to be capable of substantially maintaining a fluid therein, wherein said sidewall comprises fibers integral with matrix material, and wherein said fibers comprise fibers selected from the group consisting of helical fibers helically wound between said first end and said second end, axial fibers extending axially between said first end and said second end, and circumferential fibers circumferentially wound between said first end and said second end, said fibers thereby being oriented such that an increase in the internal pressure of said composite tubular is effective to cause said length of said sidewall to decrease, and a decrease in said internal pressure is effective to cause said length of said sidewall to increase, thereby cyclically increasing and decreasing said length of said composite tubular, thereby driving a pump coupled to said composite tubular.

50. A mooring system as in claim 12, wherein said composite tubular is one of a plurality of composite tubulars configured into a composite tubular bundle, and wherein said composite tubular bundle comprises at least one pressure neutral tubular member, wherein said pressure neutral tubular member does not change length with a varying internal pressure.

51. A riser system as in claim 30, wherein said plurality of composite tubulars are axially aligned and said sidewalls are adjacent one another.

52. A riser system as in claim 30, wherein said plurality of composite tubulars are braided to form the bundle.

53. A riser system as in claim 30, wherein said plurality of composite tubulars are coupled to form a perimeter about a central core.

* * * * *